United States Patent [19]

Scales et al.

[11] 4,449,847

[45] May 22, 1984

[54] REVETMENT PANEL

[75] Inventors: John M. Scales, Norcross; Bernard F. Wolcott, Roswell, both of Ga.

[73] Assignee: Nicolon Corporation, Norcross, Ga.

[21] Appl. No.: 424,563

[22] Filed: Sep. 27, 1982

[51] Int. Cl.[3] ..... E02B 3/12

[52] U.S. Cl. ..... 405/19; 405/18; 405/17

[58] Field of Search ..... 405/15–20, 405/24, 25, 28–35; 139/384 R, 387 R, 388

[56] References Cited

U.S. PATENT DOCUMENTS

| | | | |
|---|---|---|---|
| Re. 27,460 | 8/1972 | Lamberton . | |
| 3,396,542 | 8/1968 | Lamberton | 405/18 |
| 3,396,545 | 8/1968 | Lamberton | 405/233 |
| 3,397,260 | 8/1968 | Lamberton | 264/86 |
| 3,474,626 | 10/1969 | Colle | 405/18 |
| 3,561,219 | 2/1971 | Nishizawa et al. | 405/19 |
| 3,696,623 | 10/1972 | Heine et al. | 405/19 |
| 3,699,686 | 10/1972 | DeWinter | 405/19 |
| 3,786,640 | 1/1974 | Turzillo | 405/18 |
| 3,837,169 | 9/1974 | Lamberton | 405/18 |
| 3,957,098 | 5/1976 | Hepworth et al. | 150/9 |
| 4,102,137 | 7/1978 | Porraz et al. | 405/18 |
| 4,135,843 | 1/1979 | Umemoto et al. | 405/18 |
| 4,154,061 | 5/1979 | Umemoto et al. | 405/19 |
| 4,184,788 | 1/1980 | Colle | 405/19 |

FOREIGN PATENT DOCUMENTS

| | | |
|---|---|---|
| 46-636074 | 6/1971 | Japan . |
| 48-706813 | 4/1973 | Japan . |

OTHER PUBLICATIONS

Waterways, Port, Coastal and Ocean Division of American Society of Civil Engineers, *Coastal Structures* 79 (vols. I & II 1979).

Brochure Entitled "Fabric Forms for Concrete".

Fabriform ® brochure in Japanese.

Brochure Entitled "Fabriform ® Concrete Forming System".

Brochure Entitled "Fabriform ® Concrete Bags".

Brochure Entitled "Fabricast ® Molded Blocks".

Brochure Entitled "Fabricast ® Molded Gravity Blocks".

Brochure Entitled "Fabriform ® is the Solution to Erosion Problems".

*Primary Examiner*—Dennis L. Taylor

*Attorney, Agent, or Firm*—James L. Ewing, IV

[57] ABSTRACT

A revetment panel for installation along embankments and other earthen structures, including structures partially or fully covered by water, which utilizes a fabric web having a plurality of compartments separated by selvage. The web is formed of two fabric layers, which are woven separately on the same loom to form the compartments, and interwoven to form the selvage. The fabric layers are separately woven to form slots in the selvage which allow cables to pass through the web, and which allow filler material to flow between compartments during filling. The web is transported to its installation site, and placed. The compartments in the web are then inflated with the filler material, which may be cementitous slurry or mortar consisting in part of sand and gravel found near the installation site, or simply a mixture of sand, gravel, and water. The resulting matrix of forms interconnected by fabric and cable provides a durable, economical and flexible erosion control layer. Later, the fabric may wear away leaving a highly articulable mat of hardened forms interconnected by cable or other connecting means.

20 Claims, 10 Drawing Figures

REVETMENT PANEL

BACKGROUND OF THE INVENTION

This invention relates to a revetment panel comprising a matrix of forms interconnected by cables and fabric, and a method of constructing in situ the revetment panel. The invention is used for erosion control or other purposes and is typically placed on embankments and other earthen structures below, at and above the waterline.

It has long been known to place erosion control structures along river and channel banks, shorelines and coastlines, and other places subject to erosion from hydraulic forces. Such structures have taken the form of, among other things, rip-rap, unconnected concrete blocks or slabs, and prefabricated blocks or other forms which must be transported to the installation site and there interconnected by cables or interlocking means and placed into position.

Also known is the technique of constructing erosion control structures in situ by filling the void between two laid-in-place interconnected fabric layers with a flowable filler material of sand or cementitious slurry. The filler material, which may be pumped into the void between such fabric layers either above or below the waterline, may later harden into a monolithic structure.

Several techniques have previously been used to control separation of fabric layers in previous in situ formed structures as filler material is pumped between the layers, and therefore to control the thickness of the hardened, monolithic structure. The two fabric layers have been fastened in contact with each other at a plurality of spaced points. Fabric layers have also been interconnected by drop stitching them together at a predetermined distance. Straps and ties extending across the outer surfaces of the fabric layers have also been used. According to another technique, the width of the monolithic structure is controlled by a system or network of cords interconnecting or linking the fabric layers. Furthermore, wires woven into the fabric layers have been used; wires of one fabric layer are linked to wires of the other fabric layer, typically by the use of a third set of wires.

It is further known to construct in situ an erosion control structure formed of a plurality of pockets between two fabric layers, by filling the pockets with sand or cementitious filler material. The fabric layers later serve to bind together the hardened pockets. Such a network or matrix of hardened forms, unlike the monolithic hardened structures mentioned above, is able to adapt to the changing contour of the earthen surface being protected, which may slowly erode or accrete from the hydraulic forces under the structure, or which may expand or contract due to ice formation. A further advantage of such a network or matrix is that hydraulic pressure above and below the structure is more readily equalized because of the numerous spaces between the hardened forms, resulting in less stress on the hardened material than in monolithic structures. Since the integrity of such a network or matrix structure depends on the integrity of the fabric interconnecting the hardened forms, which fabric is subject to deterioration and abrasion, such a structure tends to be impermanent.

SUMMARY OF THE INVENTION

The revetment panel of the present invention has the advantageous features discussed above, but achieves these features at lower cost and more effectively than earlier systems by using a fabric web having a plurality of compartments separated and interconnected not only by selvage fabric, but also interconnected by cables or other connecting means.

During manufacture of the web, slots are left in the selvage to provide limited communication between the compartments for filling purposes and so that cables or other connecting means may later be passed through these slots and from one compartment to the next. The web is laced with cables or other connecting means and, if used, guide tubes for guiding a filler hose through the compartments. Washers and cable stops may be placed on the cables adjacent to the edges of the web to prevent leakage of filler material from the compartments in the web, and to hold the cables in place in the web. The web is then folded or rolled, packaged if necessary, transported to the site and placed. It may be placed on a prepared surface or unprepared surface, and, if desired on a filter system. The filter system may be woven or non-woven filter fabric, or a filter comprising layers of stones and sand, or other material. After the web is placed on the site, the compartments are filled with filler material which may harden and leave a matrix of hardened forms interconnected by the cables as well as by the selvage of the web. Later, the web may wear away from abrasion or decomposition, but the matrix of hardened forms remains interconnected by cables or other connecting means, and a revetment panel remains intact which is far more articulable then previous mats of hardened forms utilizing fabric layers.

The web of the present invention is produced on a single loom capable of weaving two fabric layers simultaneously, such as has been used heretofore for various purposes. In this fashion, a strong web having compartments between two fabric layers to receive filler material is formed with less time, effort and expense than in producing two fabric layers and subsequently stitching or otherwise connecting them together.

The web is placed on its prepared site by anchoring the top edge and unrolling the remainder down-slope, by weighting and dropping the bottommost portion into the water (if it must be submerged), or by any other convenient method. The end of a filler hose connected to a pump and filler material supply is then passed into a compartment which is typically several compartments up from the bottommost compartment in a column of compartments. The filler hose may be connected to the compartment by means an opening in one of the fabric layers comprising the wall of the compartment. The opening may be in the form of a rigid or fabric valve, or it may simply be a hole cut in the fabric layer. The compartments below this compartment are then filled, the filler material flowing through filling slots in the selvage. Guide tubes may be used to facilitate snaking of the filler hose through the column of ccmpartments, where such snaking may be needed, as in, for instance, installations on horizontal or subaqueous surfaces.

Locally found sand and gravel may be used to prepare the filler material for the web. By not requiring shipment of sand and gravel material, the present invention results in lower transportation costs than systems in which prefabricated blocks are transported to the site and subsequently connected by cables or other means.

It will be recognized that during the filling process the expansion of each compartment causes the selvage along its edge to draw toward the center of that compartment, and thus to buckle, to some extent, the cable within the filler material in each compartment. In this fashion, the cables interconnecting the hardened forms are securely implanted in each form.

Revetment panels of the present invention may be connected to each other by swaging or otherwise connecting together the cables protruding through the side and end selvages to provide a continous layer of flexible, durable, relatively inexpensive protection.

Accordingly, it is an object of the present invention to provide a revetment panel including a web which may be woven on a single loom to form compartments and selvage.

It is a further object of the present invention to provide a revetment panel in which the selvage between compartments has slots through which may be passed cables or other connecting means and filling means and which allow flowage of filler material between compartments during the filling process.

It is another object of the present invention to provide a revetment panel which may be constructed in situ and which comprises a network or matrix of hardened forms interconnected by fabric and cable or other connecting means.

It is still another object of the present invention to provide a revetment panel which may be constructed in situ, which originally comprises a network or matrix of hardened forms interconnected by fabric and cable or other connecting means, and which after the fabric decomposes or is abraded, remains interconnected by cable or other connecting means, and is highly articulable.

It is yet a further object of the present invention to provide a revetment panel which may be constructed in situ with locally found sand or gravel, thereby achieving a savings in effort and expense in its transportation to the site, but which has the beneficial characteristics of flexibility, adaptability, and durability found in revetment structures comprising a network or matrix of hardened forms interconnected by cable or other connecting means.

It is still a further object of the present invention to provide a revetment panel which is simple, inexpensive and quick to produce and install.

It is yet another object of the present invention to provide a revetment panel which may be constructed in situ under water, with a minimum need for divers or underwater operations.

Other objects and advantages of the present invention will become apparent during the course of the following summary and description.

DETAILED DESCRIPTION OF THE DRAWINGS

Figure 1:
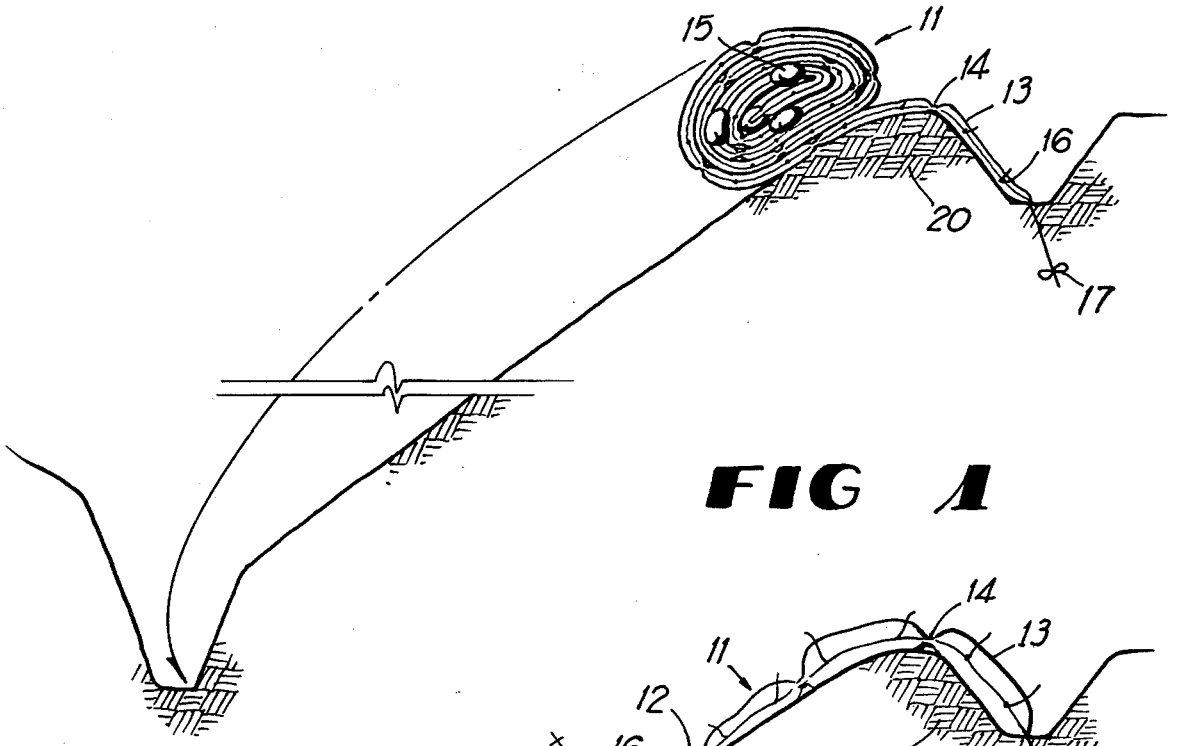
FIG. 1 is a side elevational view of the web of the present invention during placement on its prepared site.

FIG. 1–4 are side elevational views illustrating installation of the present invention. In FIG. 1, a web 11 of the present invention is shown during placement on its prepared site. The site may be any surface 20 prone to erosion, including banks and shorelines along rivers and channels, bridge embankments, and cuts and fills along road and railroad rights of way. The site may be prepared, if desired, by cutting toe and/or anchor trenches and grading; however, the present invention is equally effective and easily placed where site preparation is not or cannot be undertaken, such as along the icy and rocky coastlines found in arctic climates.

Placement of web 11 on a submerged or partially submerged site such as that depicted in FIGS. 1–4 may be facilitated by weights 15 attached along its bottom and side edges. Weights 15 may be press-on type lead weights, or they may take the form of chain attached along the bottom and/or side edges of web 11. Web 11 may be deployed by being rolled downhill from its anchored edge, as depicted in FIG. 1; its bottommost end may be towed and released over the installation site; or any other suitable method of deployment may be used. The first method is particularly suited for shallow water installations, and since no barge or boat is required, is convenient. Towing is particularly appropriate in deep water installations, or where web 11 has been folded and stacked rather than rolled during packaging at the manufacturing site. Accurate placement may be ensured by a remote-actuated release bar which may be attached to the bottommost edge of web 11, and to the towing barge or boat by an activation line. The top edge of web 11 may be anchored during the filling process by attaching cables 16 protruding from web 11 to anchors 17; similarly, one or more of the uppermost compartments may be placed in a top trench and filled, or simply filled to act as an anchor. Anchors 17 may take the form of helix earth anchors, dead men, buried pipe or other suitable means.

Figure 3:
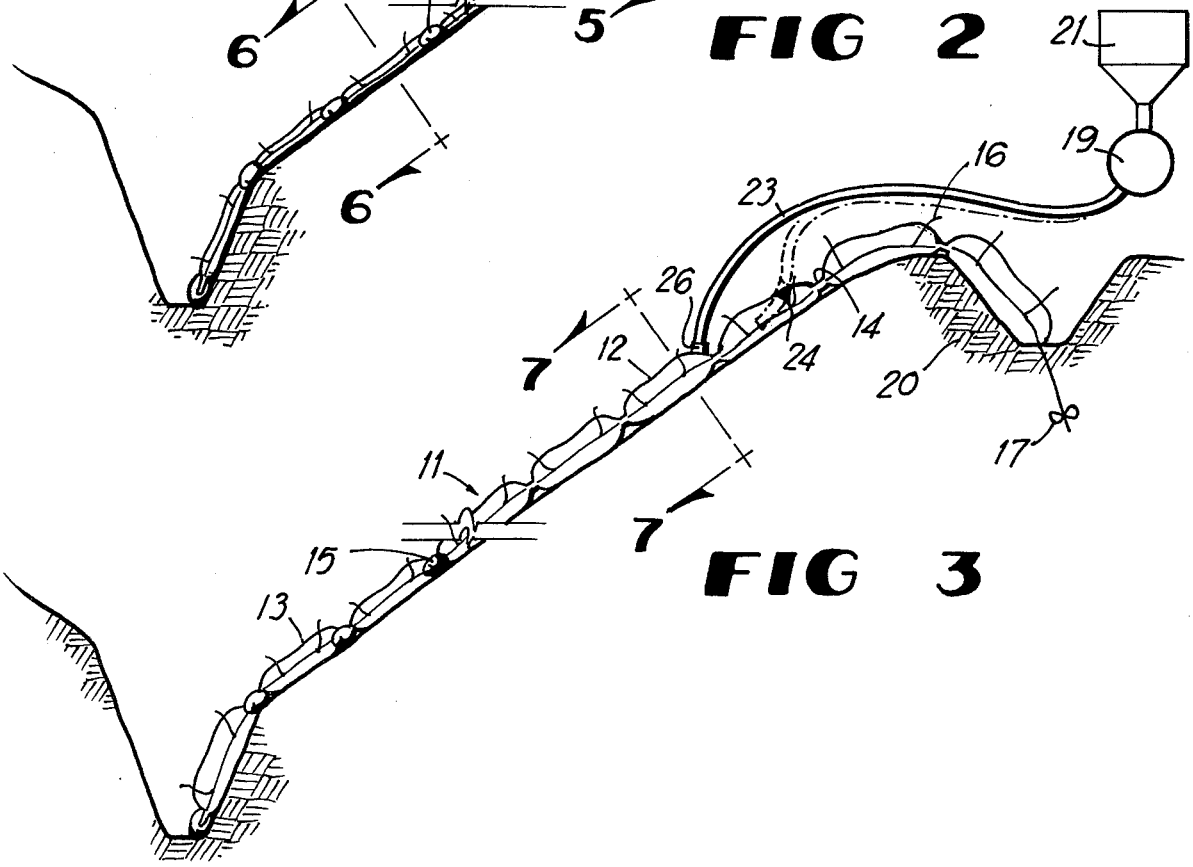
FIG. 3 is a side elevational view of the web of the present invention showing compartments being filled with filler material.
Figure 4:
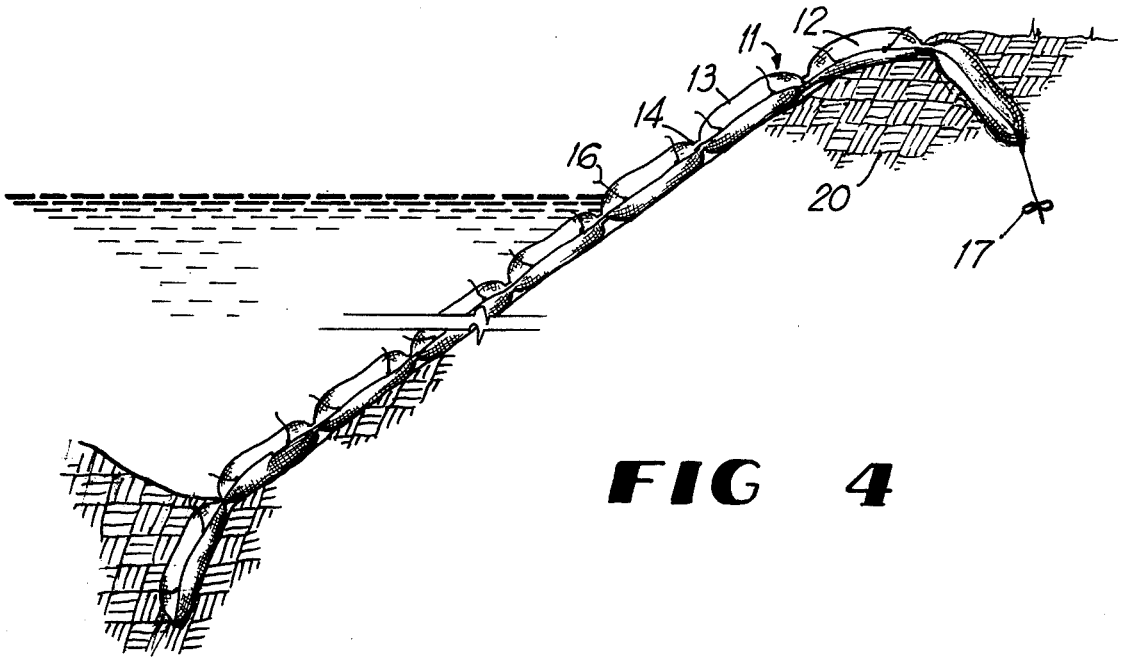
FIG. 4 is a side elevational view of the present invention after installation on a prepared site.

Referring to FIG. 3, compartments 13 of web 11 are filled with the aid of pump 19, a filler material supply 21 and filler hose 23. Web 11 is generally filled by filling a column of compartments 13 at a time. Filling is typically accomplished by cutting an opening 24 in a compartment 13 which is usually several compartments from the bottommost compartment. Filler hose 23 is then inserted and filler material 28 pumped through this opening 24. Filler material 28 flows through filler slots 27 in such a manner as to allow uniform filling of all compartments 13 below the compartment 13 in which opening 24 is cut. Filler material 28 is pumped to a predetermined pressure, which may be great enough to eject a portion of the water from filler material 28, thereby allowing quicker hardening. Filler hose 23 is then withdrawn from opening 24, which may then be sealed, and the process is repeated to accomplish filling of web 11. Where compartments 13 are situated in an anchor trench and thus situated on a gradient opposite in direction to the surface 20 being protected, they may similarly be filled, before, during, or after filling of the remainder of web 11. If such compartments 13 are filled before the remainder of web 11, they tend to anchor that remainder as it is filled, and thus to prevent slippage of web 11 during filling.

Figure 9:
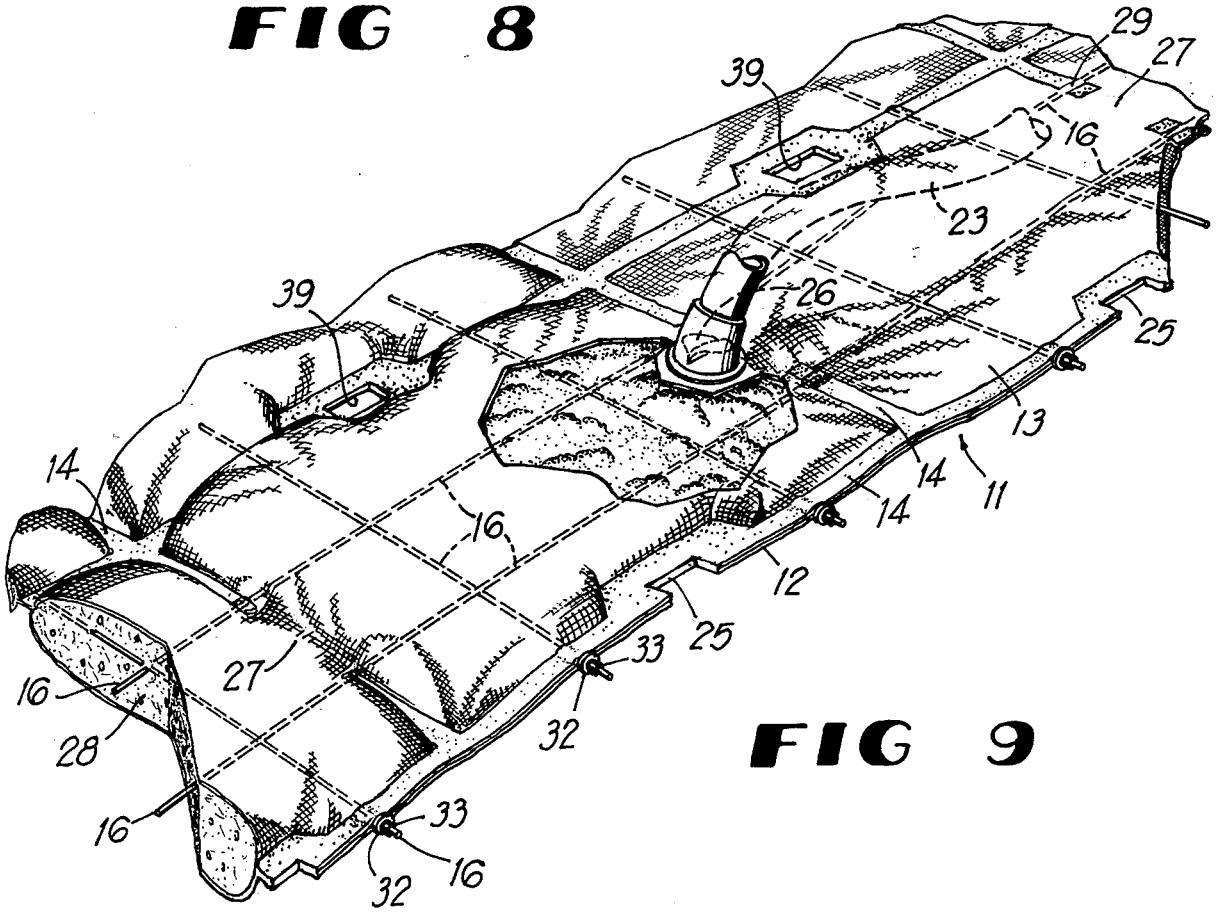
FIG. 9 is a partial perspective view of the web of the present invention being filled with filler material.

Opening 24 may take the form, rather than being cut into fabric layers 12, of valves 26 which are placed in fabric layers 12, as shown in FIGS. 3 and 9. Such valves 26 may be affixed at the manufacturing site or at the installation site, in a configuration suitable to the terrain features and other requirements of a particular installation. Valves 26 allow a one-way flow of filler material 28, and allow easy connecting and disconnecting of filler hose 23.

Figure 8:
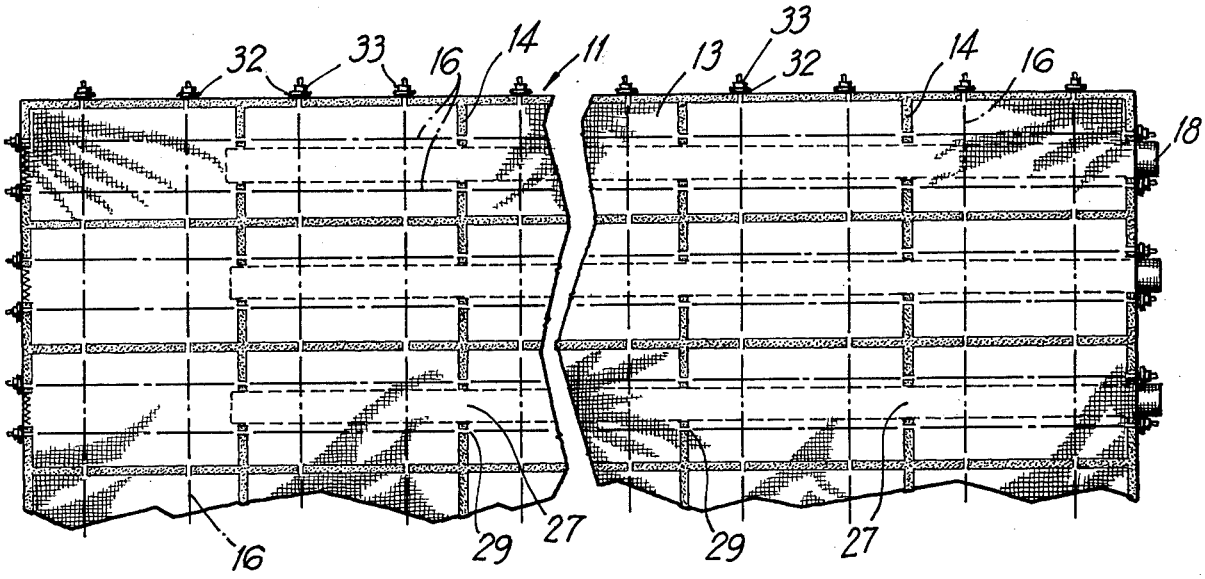
FIG. 8 is a plan view of the web of the present invention illustrating an arrangement of the guide tubes which may be used.

If guide tubes 18 are used, as shown in FIG. 8, filler hose 23 is inserted into a guide tube 18, which may extend from the top edge of web 11, through a column of compartments 13 and through filling slots 27 in selvage 14, to the bottom most compartment 13 in the column. Guide Tubes 18 may, alternatively, extend through rows of compartments 13, depending on the orientation of filler slots 27 through which they pass from compartment 13 to compartment 13. Guide tubes 18 may be of the same material as web 11, material permeable to filler material 28, semi-rigid and non-permeable material, or any other appropriate material. Guide tubes 18 are typically placed in web 11 during manufacture, but may be placed therein subsequent to the time web 11 leaves the manufacturing plant. Filler material 28 is pumped into the bottommost or end most compartment 13 to a predetermined pressure, which may be great enough to eject a portion of the water from the filler material 28, thereby causing the filler material 28 to harden more quickly. After a compartment 13 is filled, guide tube 18 and filler hose 23 are withdrawn into the next compartment 13 to be filled. Where guide tubes 18 permeable to filler material 28 are used, they need not be withdrawn. In some instances, where the entire bottom row or end column of compartments 13 must be filled first, filler hose 23 be withdrawn from guide tube 18, placed in the adjacent guide tube 18, and inserted into the bottommost or endmost compartment 13 of the adjacent column or row, which is then filled. Guide tube 18 may then be withdrawn into the next compartment, filler hose 23 withdrawn from guide tube 18, and the process repeated to achieve filling of web 11.

It will be recognized that the pumping of filler material 28 into compartments 13 causes the edges of those compartments to draw inward, thereby pulling the unfilled compartments 13 of web 11 toward the filled compartments. Such shrinkage of approximately 20% of prefilled dimensions of web 11 is typically encountered. Thus, the filling sequence of compartments 13 determines the final position of web 11, and site conditions may require alternative filling sequences to ensure correct final replacement.

Web 11 is produced on a loom which is capable of weaving two sheets of fabric simultaneously, and which may be programmed or configured to interweave the two sheets of fabric where appropriate to produce a single selvage layer. In the present invention, the loom is configured to weave web 11, also shown in plan in FIG. 8, by weaving two separate sheets of fabric or fabric layers 12 which form the walls of compartments 13, and by interweaving the two sets of fabric to form selvage 14 interconnecting and separating compartments 13. Web 11 may be woven of nylon, fiberglass, natural fiber, polypropylene, or any other material having the appropriate ultraviolet-sensitivity, flexibility, porosity, durability and cost parameters required for a given installation. The top fabric layer 12 may be material different from that of the bottom fabric layer 12; for instance, the top layer may be a sacrificial layer and the bottom a UV-stabilized layer, to achieve a resulting revetment panel of hardened forms interconnected by cables or other means lying atop a layer of filter fabric. Obviously, other combinations of fabric layers 12 may be used to achieve differing results.

Cables 16 which are placed in web 11 during manufacture are permanent in nature, and must be of sufficient strength and durability to interconnect hardened forms 30 of the present invention long after fabric layers 12 have worn away. They may be aircraft cable, other metallic cable. rope, chain, fabric or polypropylene straps, or of any other similar means having the requisite strength and durability.

Filler material 28 may be a slurry or mortar of cementitious material, or it may simply be a mixture of water and sand, water, sand and gravel, or other appropriate material, if integrity of the revetment panel after degradation of web 11 is not a concern. In either event, locally found sand and gravel may be used.

Figure 2:
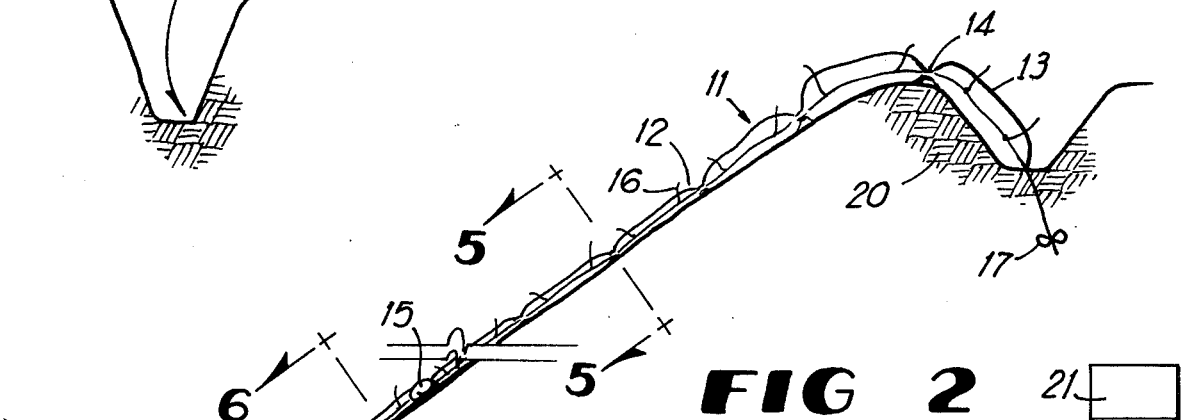
FIG. 2 is a side elevational view of the web of the present invention lying in place.
Figure 5:
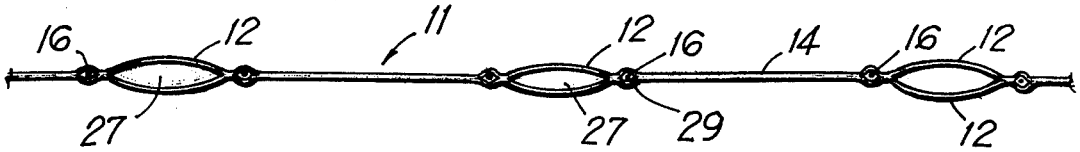
FIG. 5 is a cross-sectional view taken along line 5—5 of FIG. 2, through the selvage of the web of the present invention.

FIG. 5 shows a longitudinal cross-section of the lateral selvage 14 of web 11 corresponding to section 5—5 of FIG. 2. Filling slots 27 are shown, through which guide tubes 18 may be threaded during manufacture of web 11 and through which filler material 28 flows during the filling process when guide tubes 18 are not used. Cable slots 29 are also shown, through which cables 16 are threaded during web 11 manufacture, after web 11 is woven.

Figure 6:
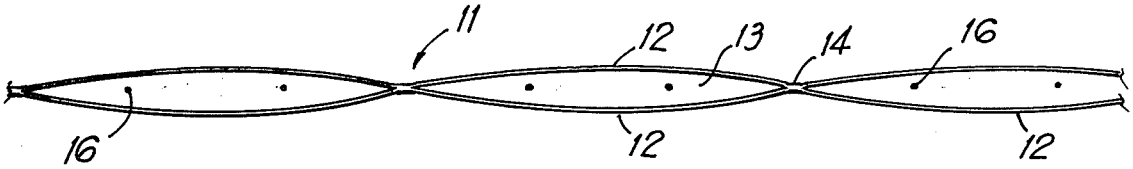
FIG. 6 is a cross-sectional view taken along line 6—6 of FIG. 2, through an unfilled compartment of the present invention.
Figure 7:
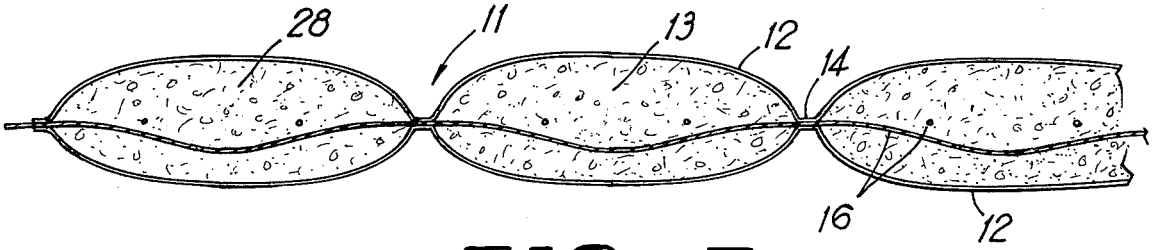
FIG. 7 is a cross-sectional view taken along line 7—7 of FIG. 3, through a filled compartment of the present invention.

FIG. 6 is a longitudinal cross-section of compartments 13 of web 11 corresponding to section 6—6 in FIG. 2. The relationship of fabric layers 12 and selvage 14 can be seen. FIG. 7, a cross-section corresponding to section 7—7 of FIG. 3, shows filler material 28 in compartments 13. Cable 16 is also illustrated, passing laterally through compartments 13, as well as longitudinally.

FIGS. 8 and 9 illustrate placement of selvage 14 and cables 16 in web 11. Selvage 14, if permeable to water, acts as a membrane to relieve the hydraulic pressure differential above and below web 11. Selvage 14 may contain one or more notches 25, as shown in FIG. 9, to allow even more relief. It may also be of serpentine, zig-zag, or other non-linear or irregular shape to interrupt and impede the flow of water in the vicinity of the selvage. Furthermore, holes 39 may be cut or burned in selvage 14 to increase the permeability of web 11 to water. Filling slots 27, as well as cable slots 29 in selvage 14, can also be seen.

Cables 16 extend beyond the edges of web 11 so that they may be swaged or otherwise connected to cables of other webs of the present invention and thereby allow the webs to be linked together to form a continuous layer of erosion protection. Cables 16 may be arranged in web 11 in numerous other configurations having both longitudinal and lateral orientation, by changing the locations in which the selvage 14 and the slots 29 therein are woven. At the edges of web 11, washers 32 and cable stops. 33 may be placed on cables 16 to prevent leakage of filler material 28 and to hold cables 16 in place in web 11. Cable stops may be conventional swages, knots, clips or other means for terminating cable 16.

Figure 10:
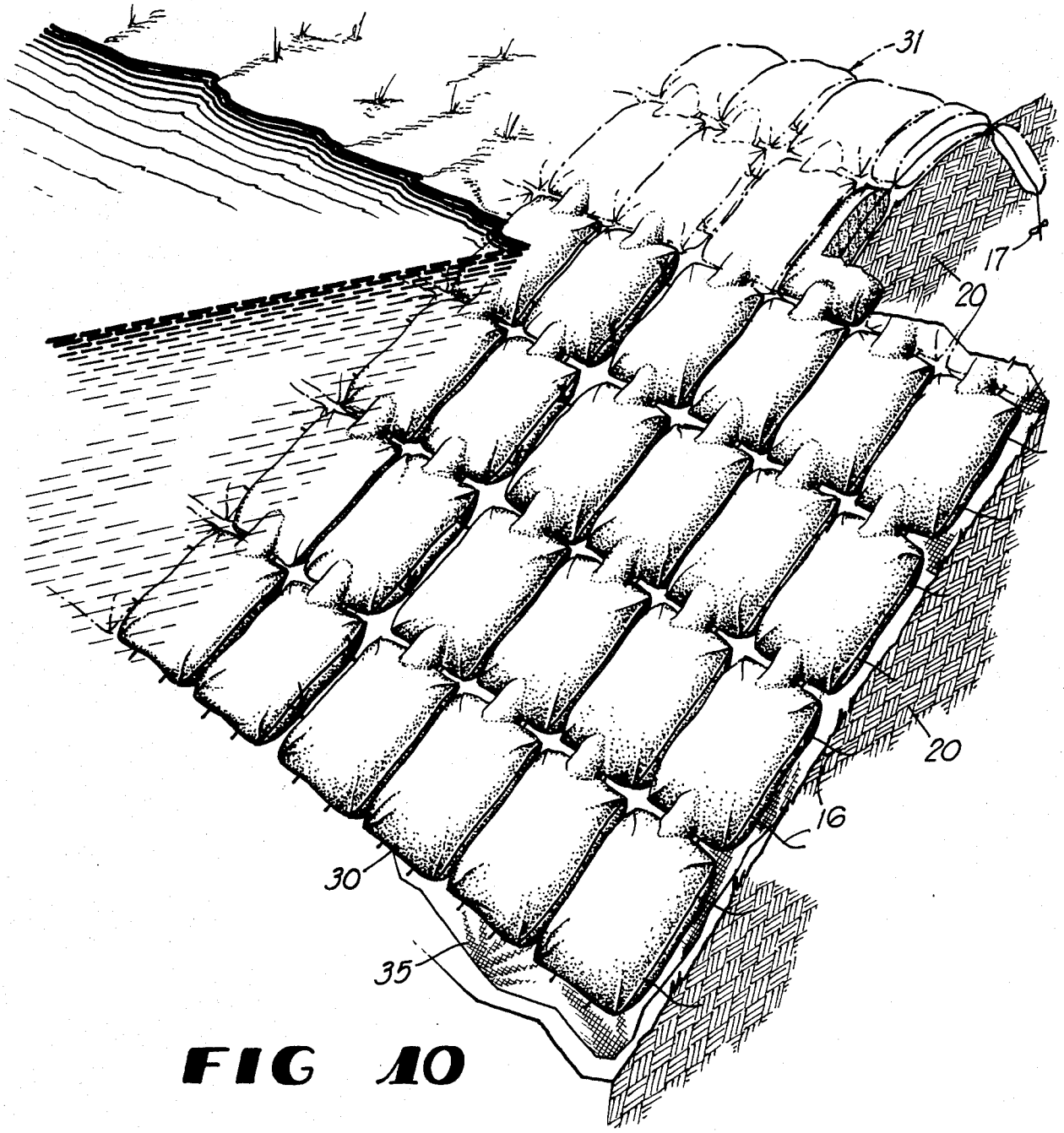
FIG. 10 is a partial perspective view of the revetment panel of the present invention in place, after the fabric layers have worn away.

Over a period of time, fabric layers 12 and selvage 14 of web 11 may wear partially or completely away leaving hardened forms 30 interconnected by cables 16 to form a revetment mat 31 as shown in FIG. 10. Because the inflated filling slots 27 are of minor cross-sectional area compared to hardened forms 30, they serve as controlled failure areas; they tend to fail or break rather than hardened forms 30 and in so doing leave a highly articulable revetment mat 31. This mat 31 of interconnected forms becomes even more articulable after one or both fabric layers 12 have worn away.

Web 11 may be installed on top of a sheet or sheets of filter fabric 35 to acheive further protection of surface 20. Such an installation may be appropriate where both fabric layers 12 are impermanent in nature, and revetment mat 31 would otherwise be without filtering means after fabric layers 12 have worn away.

The foregoing description of the present invention is for purposes of explanation and illustration. It will be apparent to those skilled in the relevant art that modifications and changes may be made to the invention as thus described without departing from the scope and spirit thereof.

We claim:

1. A web comprising:

(a) an upper and a lower fabric layer;

(b) a plurality of interconnected compartments, the walls of which are formed where the fabric layers are woven separately;

(c) selvage separating the compartments, formed by interweaving the fabric layers;

(d) a plurality of cable slots formed in the selvage, where the fabric layers are woven separately, each of the cable slots communicating with one or more of the compartments; and (e) a plurality of cables passing through the cable slots and interconnecting the compartments.

2. The web of claim 1 further comprising a plurality of filling slots formed in said selvage, where said fabric layers are woven separately, each of the filling slots communicating with one or more of said compartments.

3. The web of claim 2 further comprising an opening in said walls of at least one of said compartments, the openings communicating between the exterior and interior of the compartments.

4. The web of claim 2 further comprising at least one washer and at least one cable stop on at least one of said cables.

5. A web comprising:

(a) an upper and a lower fabric layer;

(b) a plurality of interconnected compartments, the walls of which are formed where the fabric layers are woven separately;

(c) selvage separating the compartments, formed by interweaving the fabric layers;

(d) a plurality of cable slots formed in the selvage, where the fabric layers are woven separately, each of the cable slots communicating with one or more of the compartments;

(e) a plurality of cables passing through the cable slots and interconnecting the compartments;

(f) a plurality of filling slots formed in the selvage, where the fabric layers are woven separtely, each of the filling slots communicating with one or more of the compartments;

(g) an opening in the walls of at least one of the compartments, communicating between the exterior and interior of the compartments;

(h) at least one washer on at least one of the cables; and (i) at least one cable stop on at least one of the cables.

6. The web of claim 2 further comprising a plurality of guide tubes inserted into said filling slots to receive a filler hose during filling of said compartments.

7. The web of claim 1, 2, 3, 4, 5 or 6 wherein said upper fabric layer is of material different from that of said lower fabric layer.

8. The web of claim 1, 2, 3, 4, 5 or 6 wherein said cables are rope.

9. The web of claim 1, 2, 3, 4, 5 or 6 wherein said selvage includes portions having increased width to allow greater permeability of the web.

10. The web of claim 1, 2, 3, 4, 5 or 6 wherein said selvage has at least one hole.

11. A revetment panel comprising:

(1) a web having:

(a) an upper and a lower fabric layer;

(b) a plurality of interconnected compartments, the walls of which are formed where the fabric layers are woven separately;

(c) selvage separating the compartments, formed by interweaving the fabric layers;

(d) a plurality of cable slots formed in the selvage, where the fabric layers are woven separately, each of the cable slots communicating with one or more of the compartments;

(e) a plurality of cables passing through the cable slots and interconnecting the compartments; and (2) filler material occupying the interior of the compartments of the web.

12. The revetment panel of claim 11 further comprising a plurality of filling slots forxed in said selvage, where said fabric layers are woven separately, each of the filling slots communicating with one or more of said compartments.

13. The revetment panel of claim 11 further comprising an opening in said walls of at least one of said compartments, the openings communicating between the exterior and interior of the compartments.

14. The revetment panel of claim 11 further comprising at least one washer and at least one cable stop on at least one of said cables.

15. A revetment panel comprising:

(1) a web having:

(a) an upper and a lower fabric layer;

(b) a plurality of interconnected compartments, the walls of which are formed where the fabric layers are woven separately;

(c) selvage separating the compartments, formed by interweaving the fabric layers;

(d) a plurality of cable slots formed in the selvage, where the fabric layers are woven separately, each of the cable slots communicating with one or more of the compartments;

(e) a plurality of cables passing through the cable slots and interconnecting the compartments;

(f) a plurality of filling slots formed in the selvage, where the fabric layers are woven separately, each of the filling slots communicating with one or more of the compartments;

(g) an opening in the walls of at least one of the compartments, communicating between the exterior and interior of the compartments;

(h) at least one washer on least one of the cables;

(i) at least one cable stop on at least one of the cables; and (2) filler material occupying the interior of the compartments in the web.

16. The revetment panel of claim 11 further comprising a plurality of guide tubes inserted into said filling slots to receive a filler hose during filling of said compartments.

17. The revetment panel of claim 11, 12, 13, 14, 15 or 16 wherein said upper fabric layer is of material different from that of said lower fabric layer.

18. The revetment panel of claim 11, 12, 13, 14, 15 or 16 wherein said cables are rope.

19. The revetment panel of claim 11, 12, 13, 14, 15 or 16 wherein said selvage includes portions having increased width to allow greater permeability of said web.

20. The revetment panel of claim 11, 12, 13, 14, 15 or 16 wherein said selvage has at least one hole.

* * * * *